United States Patent [19]

Hunter

[11] 3,965,508

[45] June 29, 1976

[54] SEATING CUSHION

[76] Inventor: Ronald Bruce Hunter, 47 Cedar St. South, Timmins, Ontario, Canada, P4N 2G5

[22] Filed: Apr. 14, 1975

[21] Appl. No.: 567,871

[30] Foreign Application Priority Data

Jan. 24, 1975 Canada ..... 218623

[52] U.S. Cl. ..... 5/368 WB; 297/458

[51] Int. Cl.[2] ..... A47C 27/08

[58] Field of Search ..... 297/312, 458, DIG. 3; 5/66, 347, 348 R, 349, 350, 348 WB

[56] References Cited

UNITED STATES PATENTS

| | | | |
|---|---|---|---|
| 1,039,334 | 9/1912 | Trick | 297/230 X |
| 3,185,522 | 5/1965 | Faulhaber | 5/338 X |
| 3,423,773 | 1/1969 | Yamate | 5/66 |
| 3,864,766 | 2/1975 | Prete | 5/348 R X |

*Primary Examiner*—Paul R. Gilliam
*Assistant Examiner*—Andrew M. Calvert
*Attorney, Agent, or Firm*—Otto John Munz

[57] ABSTRACT

A fluid filled cushion for wheel chairs or the like. In a preferred embodiment, the cushion is partially filled with water but it may also be filled with air or the like. The cushion has a tongue portion protruding from the front thereof. The tongue depends over the front edge of the seat of the chair and assumes horizontal position when the user of the chair is seated on the cushion, to separate the legs of the user. The invention is intended for use by paraplegics who normally do not have sufficient muscular control to keep their legs separated.

5 Claims, 2 Drawing Figures

SEATING CUSHION

The present invention relates to a cushion, particularly for use in wheel chairs or the like. The invention relates in particular to wheel chair seating cushions for use by paraplegics.

It is known to use various types of cushions on wheel chairs, the basic purpose of the cushions being to assist in a uniform distribution of weight of the applicant by increasing the area of contact of the individuals buttocks thus also reducing specific weight to which different portions of the buttocks are exposed while the person is seated, to reduce bed sores or to assist in heeling of the existing ones.

The existing cushions, which are preferably water filled meet the above requirement, yet, they do not provide a feature which is useful particularly for paraplegics, who normally do not have sufficient muscular control to separate the legs on their own.

It is therefore an object of the present invention to provide a new and useful cushion which would not only provide the above desired effect of uniform weight distribution, but would also assist in separation of a chair occupant's legs, once the occupant is seated on the cushion, without obstructing the occupant's access to the seat of the chair, to prevent Dicubtis Ulcers on inside of knees.

According to the invention, a cushion is provided for use as as a seating cushion on wheel chairs or the like, the cushion being made from a flexible, liquid impervious sheet material, the cushion being adapted to assume, after having been filled with water, the shape of a flat, substantially rectangular bag with a tongue portion protruding from one side of said bag.

The invention will now be described in greater detail with reference to the accompanying schematic drawing, showing one embodiment of the present invention, this particular embodiment being filled with water. It will be appreciated by those skilled in the art that the embodiment as hereinafter described can be modified to a greater or lesser degree. In the drawings.

Figure 1:
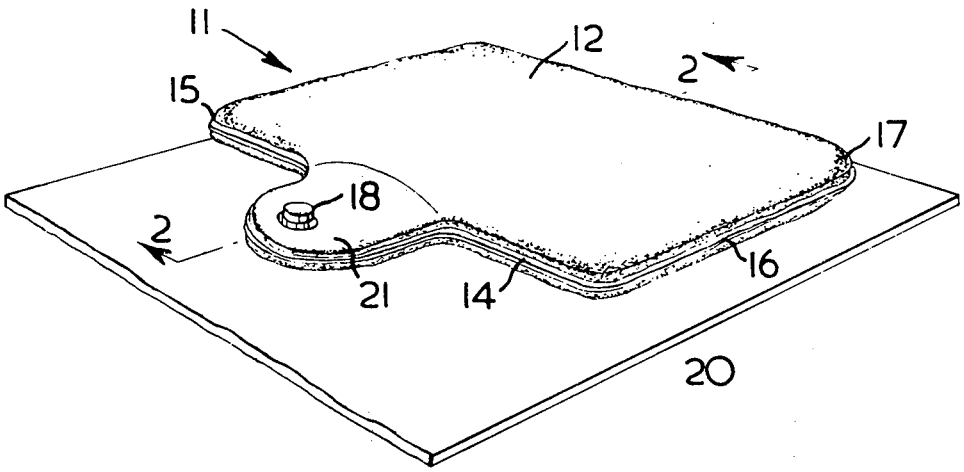
FIG. 1 is a perspective view of the cushion according to the present invention.

Turning first to FIG. 1, it will be observed that the cushion 11, which is made from a liquid impervious sheet material, such as 20 mil vinyl, has a top wall 12 and a bottom wall 13 joined by a peripheral seam formed by welding together peripheral edges of the walls 12, 13. In general, the seam is a single-piece unit having a front portion 14, two side portions 15, 16 and a back portion 17.

The peripheral seam thus forms a unit with the top and bottom walls 12, 13 and is joined with same by a welding or by any other suitable means, to obtain a liquid impervious joint. The top and bottom walls joined by the seam thus form a flat, liquid impervious, flexible container which is provided with a valve 18. The valve 18 is an ordinary, screw-type valve, the male portion of which is fixedly secured to the top wall 12, and the female portion of which can be removed from the male member to enable the filling of the container with water 19 (FIG. 2).

The cushion 11 is filled with water 19 and, when positioned on a flat surface 20, assumes the shape of a flat, substantially rectangular bag, from one side of which protrudes a tongue 21. As best seen from FIG. 1, the valve 18 is located on the top wall 12 of the cushion, in its tongue portion. The cushion 11 is filled with water at substantially ambient pressure, in other words, water is poured into the opened valve 18 to substantially fill-in the inside of the cushion 11 to approximately 25 mm thick layer and the valve 18 is then closed.

Figure 2:
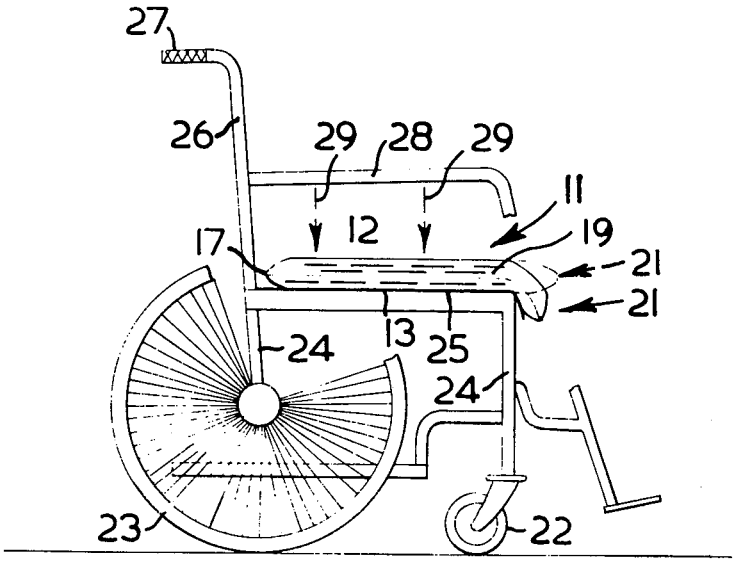
FIG. 2 is a side elevation of a wheel chair with a cushion according to the present invention, the cushion being shown in section substantially corresponding to section 2 — 2 of FIG. 1.

FIG. 2 shows a schematic side elevation of a wheel chair having a pair of front wheels or casters 22 and a pair of rear wheels 23 (only one of each of the wheels being shown). The wheels 22, 23 support a frame 24 the upper portion of which forms a support for a seat made from a suitable flat, substantially rigid material such as vinyl or the like. The rear portion of the frame 24 carries a back rest frame terminating at handles 27 and supporting arm rests 28.

It is well known that the seat 25 of a wheel chair, as viewed from top, is normally of a substantially rectangular shape, the dimensions of the seat being normally about 13 inches by 19 inches.

Turning back to the cushion 11, it has been mentioned that the water-filled cushion is substantially rectangular, the term "substantially rectangular" in this context means that the side portions 15, 16 of the seam are substantially parallel with one another and the back portion 17 is substantially perpendicular to both side portions 15, 16 and extending between the same, and that an imaginary line drawn between front ends of the side portions 15, 16 which would be substantially coincident with a part of the front portion 14 of the seam (except its section forming a part of the tongue 21), would be substantially parallel with the back portion 17. The corners and edges of the bag are suitably rounded. Basically, the above described "substantially rectangular" portion of the bag is adapted to correspond in size to the size of the seat 25.

When the water-filled cushion 11 is positioned on the seat 25, the tongue portion 21 extends over the front edge of the seat 25. Due to the inside water weight and to flexibility of the cushion walls, the tongue portion 21 will depend over the front edge of the seat (FIG. 2 - full lines).

However, as soon as the user of the wheel chair is seated on the cushion, the person's weight develops a load pressure in downward direction (arrows 29 in FIG. 2), thus increasing the pressure of water inside the cushion. The increased water pressure inside the cushion now forces the tongue portion 21 to assume a horizontal position (broken line in FIG. 2) and the tongue 21 maintains such position until the load pressure is relieved, i.e. as long as the user remains seated on the cushion. As the tongue 21 is located in the middle of the front portion 14 of the peripheral seam, it is now located between the user's legs, keeping the legs separated and thus increasing the comfort of the user.

The bag or cushion 11 may be suitably fixed to the chair by means of straps or the like (not shown in the drawing), although it has been found that such fasteners may be unnecessary due to the weight of the cushion.

It has been found that the following general dimensions of the bag or cushion as shown in FIG. 1 are preferable: distance between the side portions 15 and 16 = about 480±50 mm; length of the side portions from back to front: about 500±15 mm; width of the tongue portion: about 130 mm to 180 mm: length of the tongue portion about 140 mm to 165 mm; the top portions front end being rounded at radius of approximately 65 mm to 75 mm; the back portion of the tongue at the front portion 14; approximately 65 mm; thickness of the cushion (average distance between the top and bottom wall when filled): approximately 40 mm.

It will be appreciated that various modifications of the above embodiment can be effected. For instance, the bag is adapted to be filled with water and air at ambient pressure. However, modifications to the disclosed embodiment, making it suitable for filling by low pressure air are also possible. These and other changes, however, do not depart from the scope of the present invention as defined in the following claims.

The embodiments of the present invention in which an exclusive property or privilege is claimed are defined as follows:

1. A cushion for use as a seating cushion for invalids on wheel chairs or the like, made from a flexible, fluid impervious sheet material, comprising:

an airtight hollow seat portion;

a hollow tongue portion in conduit communication with the said hollow seat portion and extending therefrom beyond the proposed seating area into the space intended for the invalid's legs and a closeable orifice in communication with the said hollow tongue and seat portions, whereby when the said cushion with said hollows filled with a fluid at ambient pressure is laid upon the seat of a chair leaving said tongue portion to depend downwardly in a seat unoccupied state, a person's weight subsequently occupying said cushion expresses an amount of fluid into said tongue portion to lift it into a horizontal position to assist in separation of the legs of the invalid.

2. A cushion as claimed in claim 1, wherein said bag has a substantially rectangular shape and is adapted to correspond in shape to that of a seat of said wheel chair, with said tongue portion extending beyond the front edge of said seat.

3. A cushion as claimed in claim 2, wherein said tongue portion forms a unit communicating with the inside of said substantially rectangular bag.

4. A cushion as claimed in claim 3, wherein said bag is adapted to be filled with water at ambient pressure and secured to the seat of a wheel chair, whereby said tongue portion depends downwardly from the front edge area of said seat with the cushion unloaded with a person's weight, said tongue being adapted to assume a substantially horizontal position when said person is seated on the cushion, to assist in separation of the person's legs.

5. A cushion for use in a wheel chair for invalids, comprising:

a. a top wall made of flexible, liquid impervious sheet material;

b. a bottom wall made of flexible, liquid impervious sheet material;

c. said top and bottom walls being joined along peripheral edges thereof to form a flat, liquid impervious container;

d. valve means in one of said walls for filling said container with a liquid and for maintaining the filled container closed;

e. said top wall and said bottom wall being of a substantially rectangular shape and having a tongue portion projecting from the center of one side of said substantially rectangular shape;

f. the interior of the tongue portion forming a part of the interior of the cushion and communicating with the interior of the remaining part of said container.

* * * * *